US009531064B2

(12) United States Patent
Keen et al.

(10) Patent No.: US 9,531,064 B2
(45) Date of Patent: Dec. 27, 2016

(54) ANTENNA ASSEMBLY WITH ATTACHMENT FITTINGS AND ASSOCIATED METHODS

(71) Applicant: Thales, Inc., Melbourne, FL (US)

(72) Inventors: R. Michael Keen, Malabar, FL (US); William David McCune, Tehachapi, CA (US); Brian D. Anderson, Apopka, FL (US)

(73) Assignee: THALES, INC., Melbourne, FL (US)

( * ) Notice: Subject to any disclaimer, the term of this patent is extended or adjusted under 35 U.S.C. 154(b) by 115 days.

(21) Appl. No.: 14/567,685

(22) Filed: Dec. 11, 2014

(65) Prior Publication Data

US 2016/0172745 A1 Jun. 16, 2016

(51) Int. Cl.

| | |
|---|---|
| ***H01Q 1/28*** | (2006.01) |
| ***H01Q 1/50*** | (2006.01) |
| ***H01Q 1/42*** | (2006.01) |

(52) U.S. Cl.

CPC ..... *H01Q 1/28* (2013.01); *H01Q 1/42* (2013.01); *H01Q 1/50* (2013.01)

(58) Field of Classification Search

CPC ..... H01Q 1/28; H01Q 1/42
USPC ..... 343/705, 708, 872
See application file for complete search history.

(56) References Cited

U.S. PATENT DOCUMENTS 6,407,711 B1 * 6/2002 Bonebright ..... H01Q 21/205 343/705
7,420,523 B1 9/2008 Ziolkowski et al.
2012/0086613 A1 * 4/2012 Lundeen ..... H01Q 1/1214 343/705
2012/0212391 A1 8/2012 Dazet
2013/0321236 A1 12/2013 Ziolkowski
2015/0207214 A1 * 7/2015 Wallace ..... H01Q 1/42 343/705
2016/0190679 A1 * 6/2016 Fournie ..... B64C 1/36 343/872

OTHER PUBLICATIONS

Tencate Advanced Composites "Radomes & Antennas low Dielectric Composites: Product Selection Guide" TCAC_Radomes&Antennas_V1_102013: http://www.tencate.com/amer/aerospace-composites/Applications/radomes/default.aspx; Retrieved from internet on Dec. 10, 2014: 6 pgs.

* cited by examiner

*Primary Examiner* — Sue A Purvis
*Assistant Examiner* — Hasan Islam
(74) *Attorney, Agent, or Firm* — Allen, Dyer, Doppelt, Milbrath & Gilchrist, P.A.

(57) ABSTRACT

An antenna assembly is for a fuselage of an aircraft and includes a satellite antenna, a radome covering the satellite antenna, and attachment fittings for coupling to the fuselage of the aircraft. The attachment fittings include fore, aft and side attachment fittings. The fore attachment fittings react to vertical, lateral and longitudinal loads. The aft attachment fittings react to vertical and lateral loads and permit longitudinal displacement. Left side and right side attachment fittings react to vertical loads and permit lateral and longitudinal displacement. A fairing mounts the radome to the attachment fittings.

25 Claims, 14 Drawing Sheets

ANTENNA ASSEMBLY WITH ATTACHMENT FITTINGS AND ASSOCIATED METHODS

FIELD OF THE INVENTION

The present invention relates to the field of antennas, and more particularly, to an antenna assembly with attachment fittings for an aircraft, and related methods.

BACKGROUND OF THE INVENTION

Commercial aircraft typically include a satellite antenna for establishing a communication link with one or more geosynchronous satellites. The satellites may be a direct broadcast satellite (DBS) for providing television programming or a fixed satellite service (FSS) providing Internet access, for example. A DBS satellite operates within 12.2-12.7 GHz, and a FSS satellite operates within 11.7-12.2 GHz. These frequencies are within the Ku-band.

An antenna assembly carried by the aircraft includes a radome to protect the satellite antenna and associated equipment from environmental exposure. The radome needs to be strong to withstand the aerodynamic loads of the aircraft while meeting desired electrical performance characteristics. A bandwidth of a Ku-band satellite antenna compatible with DBS or FSS satellites is about 0.5 GHz. A radome compatible with the Ku-band typically includes a thin laminate skin, low density core, sandwich design. Since the bandwidth is relatively narrow, this type of radome is relatively straightforward to design to meet desired structural and electrical performance characteristics.

Airborne satellite communication links are currently being developed for K-band frequencies and Ka-band frequencies to achieve broad bandwidths for high data rates. The K-band covers 18-27 GHz and the Ka-band covers 27-40 GHz. A bandwidth of a K-band/Ku-band satellite antenna is about 22 GHz. As a result of such a wide bandwidth, it becomes more difficult to design a K-band/Ku-band radome to meet desired structural and electrical performance characteristics.

One approach for a K-band/Ku-band radome is disclosed in U.S. published patent application no. 2013/0321236. A sandwich radome structure includes a central core layer, a reinforced laminate skin adjacent each side of the central core, and outer matching layers on each of the reinforced laminates. The central core layer may include a syntactic film material with a density of 32 to 42 PCF and a relative dielectric constant range of 1.6 to 2.3. The laminate skins may include a quartz woven fabric reinforcement and a thermo-set resin. The outer matching layers may include thermo-set resin and glass bubbles with a relative dielectric constant in the range of 1.6 to 2.3. A thickness of each layer may be a multiple of a quarter wavelength at approximately the center frequency over the incidence angle range of the radome frequency range. This design is also applicable to Ku-band/K-band/Ka-band radome designs.

Another radome design is disclosed in U.S. Pat. No. 7,420,523. The radome structure includes a structural layer including plies of fibers in a resin matrix, an inside matching layer adjacent to one side of the structural layer, and an outside matching layer adjacent to the opposite side of the structural layer. Both matching layers have a dielectric constant lower than a dielectric constant of the structural layer and are made of formable sheet material assembled with the structural layer during shaping of the radome and co-cured with the structural layer resulting in a rigid final form of the radome. The matching sheet layer material during assembly includes an uncured thermoset resin with a plurality of gas-filled microspheres therein to reduce the dielectric constant of the matching layers.

Even in view of the above radomes, there is still a need to provide alternative designs for a multi-band radome that operates over a wide bandwidth while meeting desired structural and electrical performance characteristics.

If the radome is to cover more than one satellite antenna, then weight becomes a concern since the size of the antenna assembly will increase accordingly. As an example, an existing antenna assembly for a single satellite antenna is based on a fixed attachment method that includes a large metal plate that is coupled to the fuselage of the aircraft. The metal plate includes a number of spaced apart fittings that are then coupled to the radome. The use of a metal plate is bulky and heavy. Although such a metal plate sized for a single satellite antenna may be acceptable, it becomes weight prohibitive when increased in size to cover more than one satellite antenna. Consequently, there is also a need to provide a light weight antenna assembly.

SUMMARY OF THE INVENTION

An antenna assembly is for a fuselage of an aircraft and comprises at least one satellite antenna, a radome covering the at least one satellite antenna, and a plurality of attachment fittings for coupling to the fuselage of the aircraft.

The attachment fittings may comprise at least one fore attachment fitting, at least one right side attachment fitting, at least one left side attachment fitting, and at least one aft attachment fitting. The at least one fore attachment fitting may be configured to react to vertical, lateral and longitudinal loads. The at least one right side attachment fitting may be configured to react to vertical loads and permit lateral and longitudinal displacement. The at least one left side attachment fitting may be configured to react to vertical loads and permit lateral and longitudinal displacement. The at least one aft attachment fitting may be configured to react vertical and lateral loads and permit longitudinal displacement. A fairing may mount the radome to the attachment fittings. Mounting of the antenna assembly directly to the fuselage with the attachment fittings advantageously avoids the need for a bulky and heavy mounting plate.

The fore attachment fittings may be fixed while the aft attachment fittings and the left and right side attachment fittings may be floating. As a result, the antenna assembly is light weight yet has the necessary strength to meet aerodynamic load requirements.

The fairing may have at least one vent opening therein. The antenna assembly may further comprise at least one airflow deflector carried by the fairing and cooperating with the at least one vent opening to lower a pressure within the radome during flight of the aircraft.

The fairing may have an oval shape defining right and left side low pressure regions when the aircraft is in flight. The at least one vent opening may include a first set of openings associated with the right side low pressure region, and a second set of openings associated with the left side low pressure region left side of said fairing.

The at least one fore attachment fitting may comprise a pair of laterally spaced apart fore attachment fittings.

Each of the right and left side attachment fittings may comprise a fuselage mounting bracket to be coupled to the fuselage of the aircraft, a fairing mounting bracket coupled to the fairing, and a coupling link between the fuselage mounting bracket and the fairing mount bracket. The coupling link may be rotatably coupled to at least one of the fuselage mounting bracket and the fairing mounting bracket.

The least one satellite antenna may be operable in at least one frequency range between 12 to 40 GHz. The at least one satellite antenna may comprise a first satellite antenna operable in a first frequency range, and a second satellite antenna operable in a second frequency range.

The radome may comprise a dielectric material, and at least one lightning protection element carried by the dielectric material. The antenna assembly may further comprise an elastomeric seal mounted on a lower edge of the fairing adjacent the fuselage of the aircraft.

Another aspect of the present invention is directed to method for mounting a radome to cover at least one satellite antenna mounted on the fuselage of an aircraft. The method may comprise coupling fore attachment fittings to the fuselage. The fore attachment fittings may be configured to react to vertical, lateral and longitudinal loads. The right side attachment fittings may be coupled to the fuselage. The right side attachment fittings may be configured to react to vertical loads and permit lateral and longitudinal displacement. The left side attachment fittings may be coupled to the fuselage. The left side attachment fittings may be configured to react to vertical loads and permit lateral and longitudinal displacement. The aft attachment fittings may be coupled to the fuselage. The aft attachment fittings may be configured to react vertical and lateral loads and permit longitudinal displacement. The method may further comprise attaching the fairing to the attachment fittings for mounting the radome.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
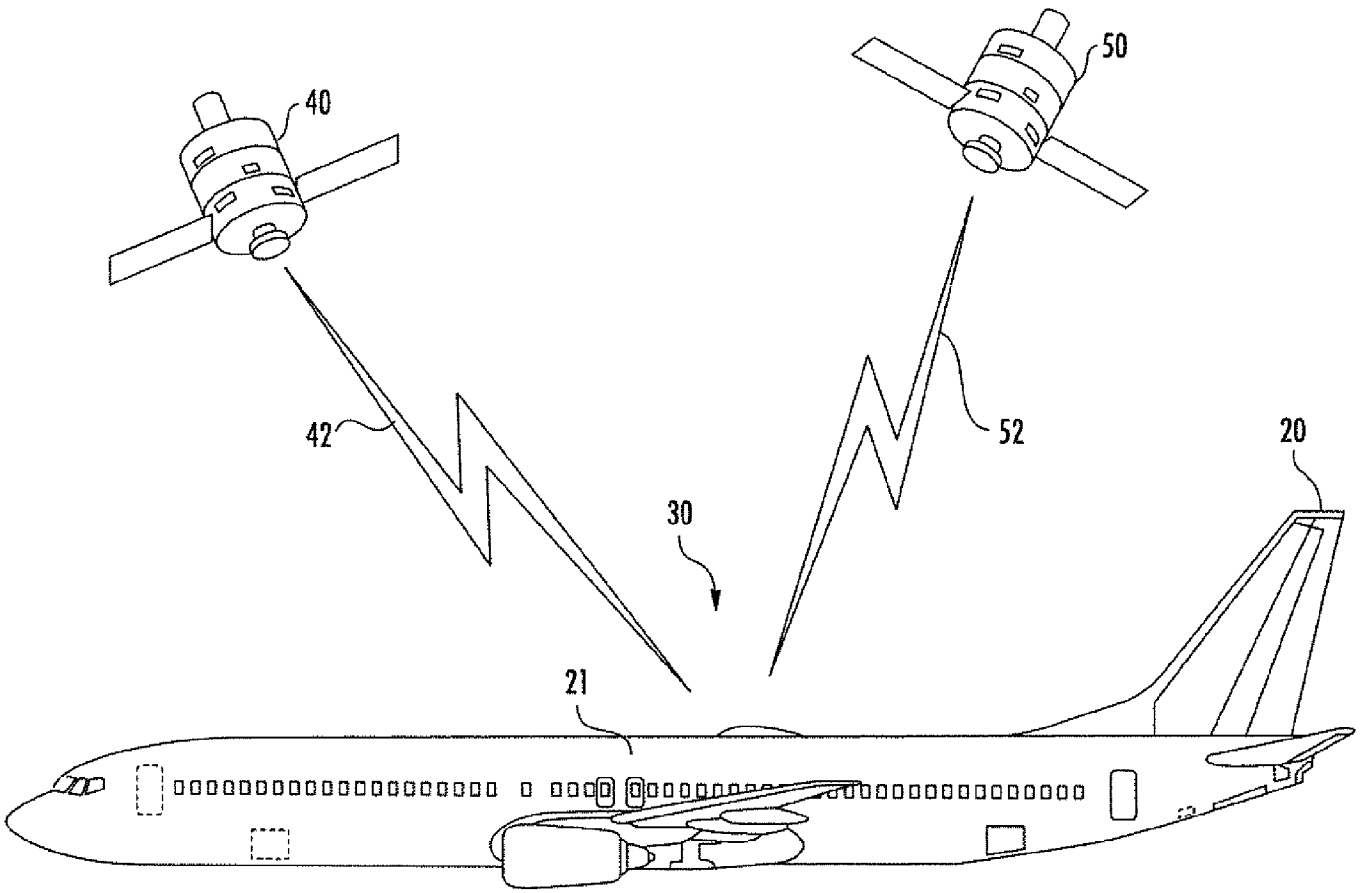
FIG. 1 is a schematic view of an aircraft with a wideband antenna assembly communicating with a pair of satellites in accordance with the present invention.

Referring initially to FIG. 1, an antenna assembly 30 is provided for a fuselage 21 of an aircraft 20. The antenna assembly 30 is configured to operate over a bandwidth of 12-40 GHz, which includes Ku-band, K-band and Ka-band. The aircraft 20 may be a commercial aircraft, for example. The illustrated antenna assembly 30 may simultaneously communicate with two different satellites 40, 50. The antenna assembly 30 may also simultaneously communicate with more than two different satellites.

Satellite 40 may operate in the Ku-band and K-band, and satellite 50 may operate in the Ka-band. Alternatively, satellite 40 may operate in the Ku-band, and satellite 50 may operate in the K-band and Ka-band. The Ku-band covers 12-18 GHz, the K-band covers 18-27 GHz, and the Ka-band covers 27-40 GHz.

Although the antenna assembly 30 is configured to operate over a bandwidth of 12-40 GHz, the communications systems carried by the aircraft 20 may operate within a subset of this bandwidth. A communications system operating within the Ku-band may operate within 12-12.7 GHz, for example. A communications system operating within the K-band may operate within 18.3-20.2 GHz, for example. A communications system operating within the Ka-band may operate within 28.1-30 GHz.

For illustration purposes, satellite 40 may be a direct broadcast satellite (DBS) for providing television programming or a fixed satellite service (FSS) providing Internet access over communications link 42. A DBS satellite operates within 12.2-12.7 GHz, and a FSS satellite operates within 11.7-12.2 GHz. As previously noted, satellite 40 may also operate within 18.3-20.2 GHz within the K-band. Satellite 50 operates over communications link 52 and is intended to supplement Ku-band channel capacity. More particularly, satellite 52 may operate within 28.1-30 GHz.

Referring now to FIGS. 2-5, the antenna assembly 30 will be discussed in greater detail. The antenna assembly 30 is aerodynamically designed to provide low drag while having the necessary strength to meet aerodynamic load requirements. Aerodynamic load requirements may reach 4,000 pounds, for example, for a typically passenger aircraft.

The antenna assembly 30 includes a first satellite antenna 32 operable in a first frequency range, and a second satellite antenna 34 operable in a second frequency range. The first frequency range is within the Ka-band, which covers 27-40 GHz. The second frequency range is within the K-band and Ku-band, which covers 12-27 GHz. A radome 60 covers the first and second satellite antennas 32, 34. A fairing 70 mounts the radome 60 to the fuselage 21 of the aircraft 20.

The radome 60 includes a pair of forward diverter strips 62*a*, 62*b* for lightning protection. The diverter strips are also referred to as lightning protection elements. There is a gap between the ends of the forward diverter strips 62*a*, 62*b* along a centerline of the radome 30. The other ends of the forward diverter strips 62*a*, 62*b* are connected to fasteners used to secure the radome 60 to the fairing 70. These fasteners are then grounded to the aircraft 20 via respective grounding straps.

The radome 60 also includes a pair of aft diverter strips 64*a*, 64*b* for lightning protection. As with the forward diverter strips 62*a*, 62*b*, there is a gap between the ends of the aft diverter strips 64*a*, 64*b* along a centerline of the radome 30. The other ends of the aft diverter strips 64*a*, 64*b* are connected to fasteners used to secure the fairing 70 to the fuselage 21. These fasteners are also grounded to the aircraft 20 via respective grounding straps.

Figure 5:
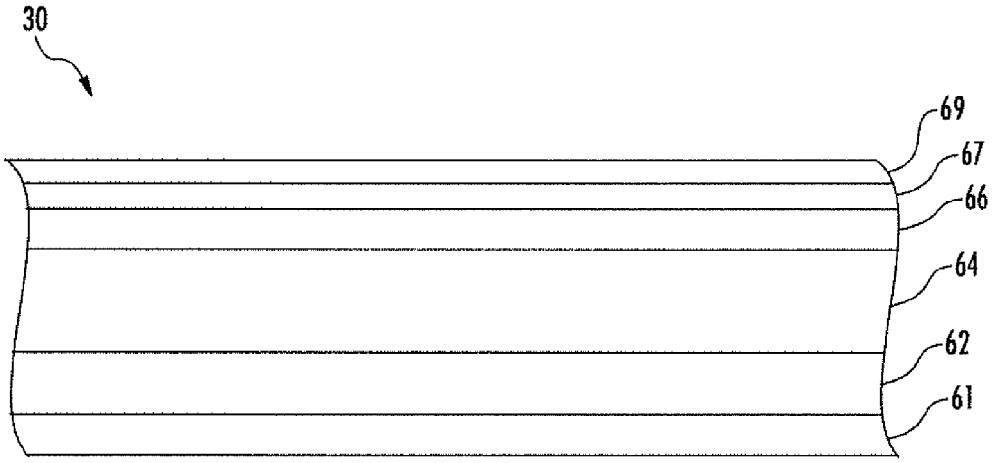
FIG. 5 is a cross-sectional view of the radome illustrated in FIG. 1.

The radome 60 is a multi-layered structure, as illustrated by the cross-sectional view in FIG. 5. The radome 60 is advantageously configured to meet aerodynamic load requirements while operating over a bandwidth of 12-40 GHz. The radome 60 has a low profile shape yet is configured to achieve a K-band insertion loss of 0.6 dB or better for incidence angles up to 65 degrees. In addition, the radome 60 is configured to achieve a Ka-band cross polarization discrimination (XPD) of −23 dB or better.

The multi-layered radome 60 comprises, in stacked relation, an inner skin 61, an inner core 62, a center laminate 64, an outer core 66, and an outer skin 67. The inner skin 61, center laminate 64 and outer skin 67 provide material strength to the radome 60. This particular arrangement of layers provides a radome 60 that can withstand aerodynamic load requirements while operating over a wide bandwidth.

The inner skin 61 and outer skin 67 each comprises a quartz fabric impregnated with an epoxy resin (prepreg). The quartz fabric may be fabric style 4503, for example. The epoxy resin may be TC250, for example, as provided by Tencate Advanced Composites of Almelo, The Netherlands. The TC250 is able to withstand an operational service temperature of 160 F. If the operational service temperature was relaxed, then other epoxy resins may be used, as readily appreciated by those skilled in the art. A thickness of the inner skin 61 is within a range of 0.005 to 0.025 inches, and a thickness of the outer skin 67 is within a range of 0.005 to 0.025 inches.

The center laminate 64 comprises multiple plies of quartz fabric each impregnated with an epoxy resin. The epoxy resin is preferably the same as used in the inner skin 61 and outer skin 67, i.e., TC250. The quartz fabrics may be a combination of fabric style 4503 and fabric style 4581, for example. A thickness of the center laminate 64 is within a range of 0.10 to 0.15 inches.

The center laminate 64 may be selected to be quartz rather than E-glass for a lower dielectric constant, better XPD performance and to reduce RF performance impacts due to manufacturing tolerances.

Between the inner skin 61 and the center laminate 64 is an inner core 62. Between the center laminate 64 and the outer skin 67 is an outer core 66. The inner and outer cores 62, 66 each comprise an epoxy syntactic foam. The epoxy is preferably the same as used in the inner skin 61, center laminate 64 and outer skin 67, and center laminate 64, i.e., TC250. The epoxy syntactic foam advantageously provides a smooth and broad impedance match between the inner skin 61 and center laminate 64, and between the center laminate and the outer skin 67 so as to permit the antenna assembly to operate over 12-40 GHz.

A dielectric constant of the inner skin 61 and outer skin 67 is 3.3, and a dielectric constant of the center laminate 64 is 3.4. A density of the epoxy syntactic foam is selected to provide a smooth and broad impedance match between these layers. The density of the epoxy syntactic foam may be chosen to provide a dielectric constant of about 1.8. Stated differently, a dielectric constant of the epoxy syntactic foam is approximately the square root of the dielectric constant of the outer skin 67. The density of syntactic foam may be increased by adding hollow particles called microballons, as readily understood by those skilled in the art. A thickness of the inner core 62 is within a range of 0.040 to 0.090 inches. A thickness of the outer core 66 is also within a range of 0.040 to 0.090 inches.

The radome 60 may further include an outer coating 69 adjacent the outer skin 67. The outer coating 69 may comprise aliphatic polyurethane. A thickness of the outer coating 69 is within a range of 0.002 to 0.008 inches. A 0.045 inch outer coating may be around the radome periphery, and a 0.0025 inch outer coating may be on a flat top surface of the radome 60, for example.

The radome 60 may be processed in a single-shot cure as compared to being precision machined so as to provide an order of magnitude cost benefit. As an alternative embodiment, the antenna assembly 30 may be made smaller to cover a single satellite antenna.

Figure 6:
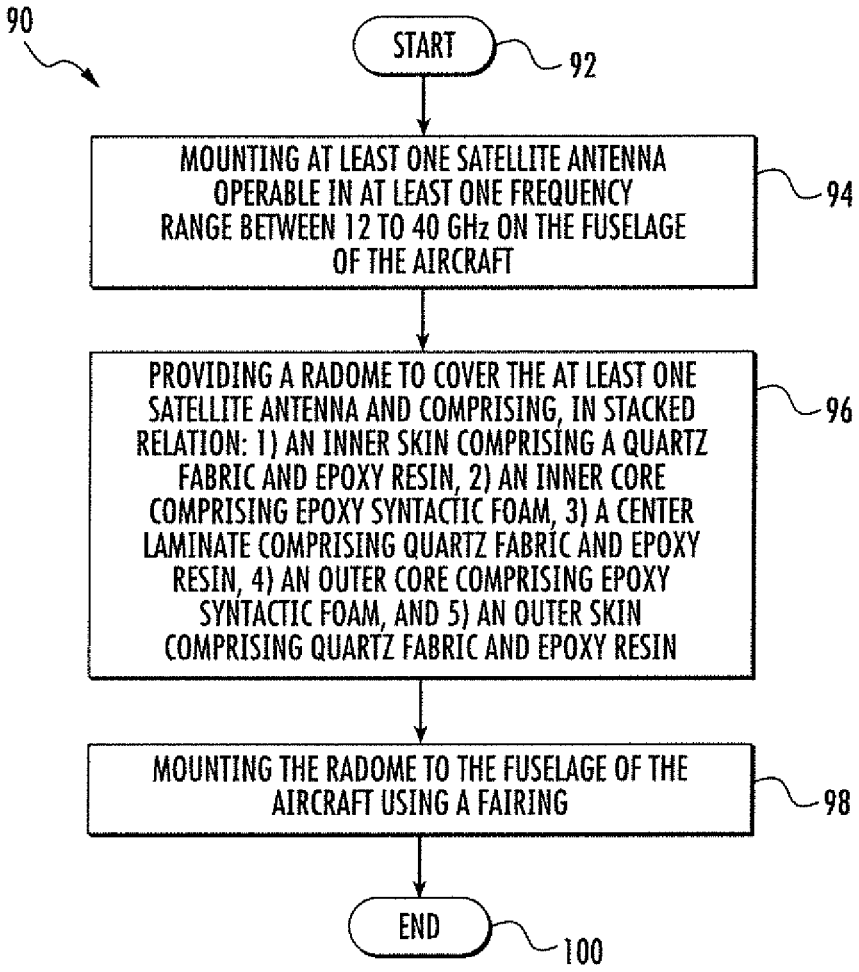
FIG. 6 is a flowchart of a method for providing an antenna assembly on a fuselage of an aircraft in accordance with the present invention.

A method for providing an antenna assembly 30 on a fuselage 21 of an aircraft 20 will now be discussed in reference to the flowchart 90 provided in FIG. 6. From the start (Block 92), the method comprises mounting at least one satellite antenna 32, 34 operable in at least one frequency range between 12-40 GHz on the fuselage 21 of the aircraft 20 at Block 94. The at least one satellite antenna 32, 34 may be directly mounted to the fuselage 21. Alternatively, the at least one satellite antenna 32, 34 may be mounted to a common structure that is then mounted to the fuselage 21.

The method further comprises at Block 96 providing a radome 60 to cover the at least one satellite antenna 32, 34. The radome 60 comprises, in stacked relation, an inner skin 61 comprising a quartz fabric and epoxy resin, an inner core 62 comprising epoxy syntactic foam, a center laminate 64 comprising quartz fabric and epoxy resin, an outer core 66 comprising epoxy syntactic foam, and an outer skin 67 comprising quartz fabric and epoxy resin. The radome 60 is mounted to the fuselage 21 of the aircraft 20 at Block 98 using a fairing 70. The method ends at Block 100.

Figure 7:
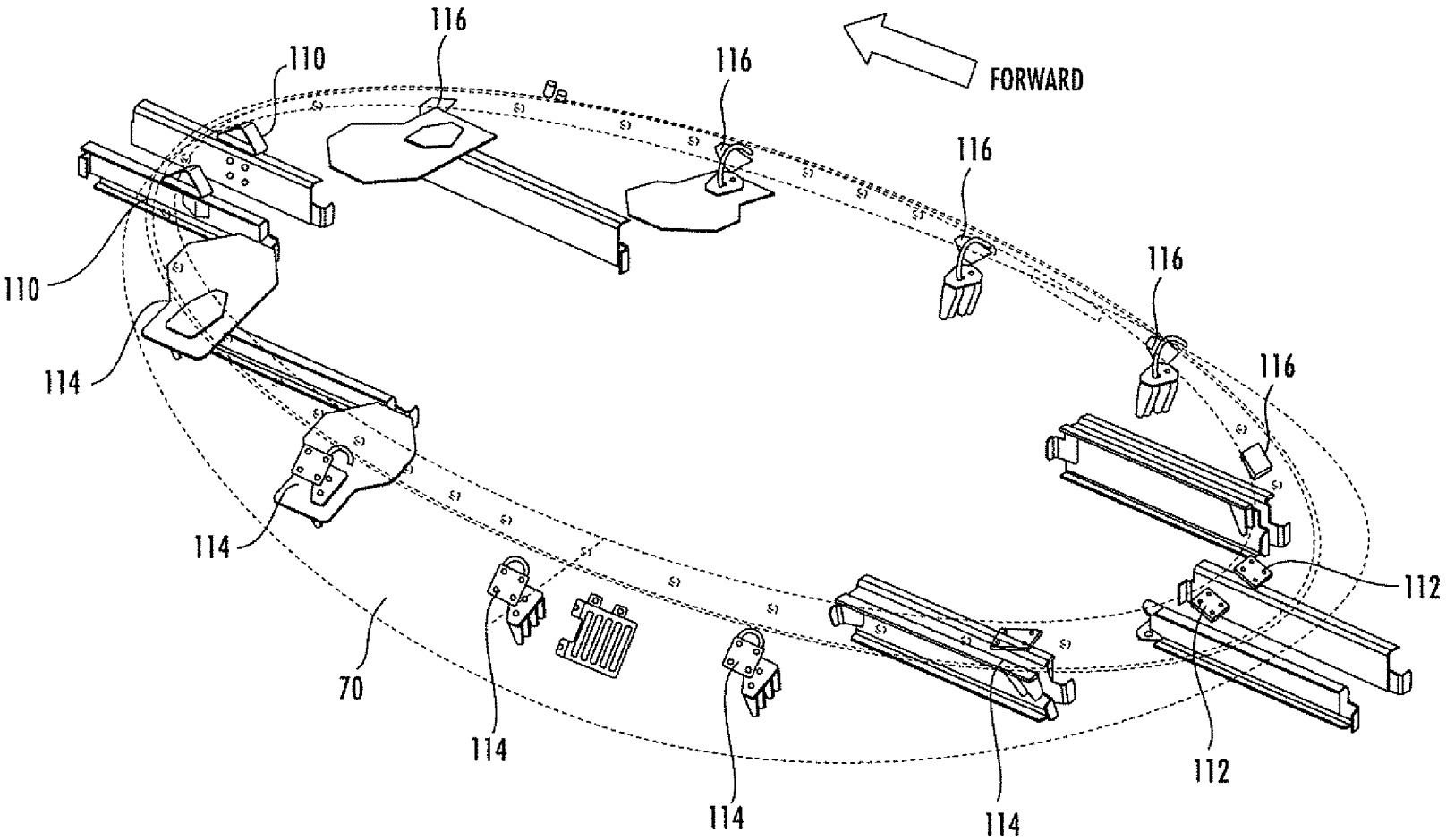
FIG. 7 is a perspective view of the fairing and corresponding attachment fittings that mount to the fuselage of the aircraft in accordance with the present invention.

Another aspect is directed to the antenna assembly 30 that includes attachment fittings 110, 112, 114, 116 to couple the fairing 70 to the fuselage 21 of the aircraft 20. Referring now to FIG. 7, the attachment fittings include a pair of fore attachment fittings 110, a pair of aft attachment fittings 112, and left and right side attachment fittings 114, 116.

Mounting of the antenna assembly 30 directly to the fuselage 21 with the attachment fittings 110, 112, 114, 116 advantageously avoids the need for a bulky and heavy mounting plate. As will be explained in greater detail below, the fore attachment fittings 110 are fixed, but the aft attachment fittings 112 and the left and right side attachment fittings 114, 116 are floating. As a result, the antenna assembly 30 is light weight yet has the necessary strength to meet aerodynamic load requirements. Aerodynamic load requirements may reach 4,000 pounds, for example.

The pair of fore attachment fittings 110 reacts to vertical, lateral and longitudinal loads. A vertical load is in the Z direction, lateral loads are side-to-side and longitudinal loads are forward to aft with respect to the aircraft. The pair of aft attachment fittings 112 reacts to vertical and lateral loads and permits longitudinal displacement.

In the illustrated embodiment, there are five left side attachment fittings and five right side attachment fittings. The left side attachment fittings react to vertical loads and permit lateral and longitudinal displacement. The right side attachment fittings also react to vertical loads and permit lateral and longitudinal displacement. The actual number of attachment fittings 110, 112, 114, 116 will vary depending on whether the radome 60 is sized to cover one or two satellite antennas, for example.

Figure 8:
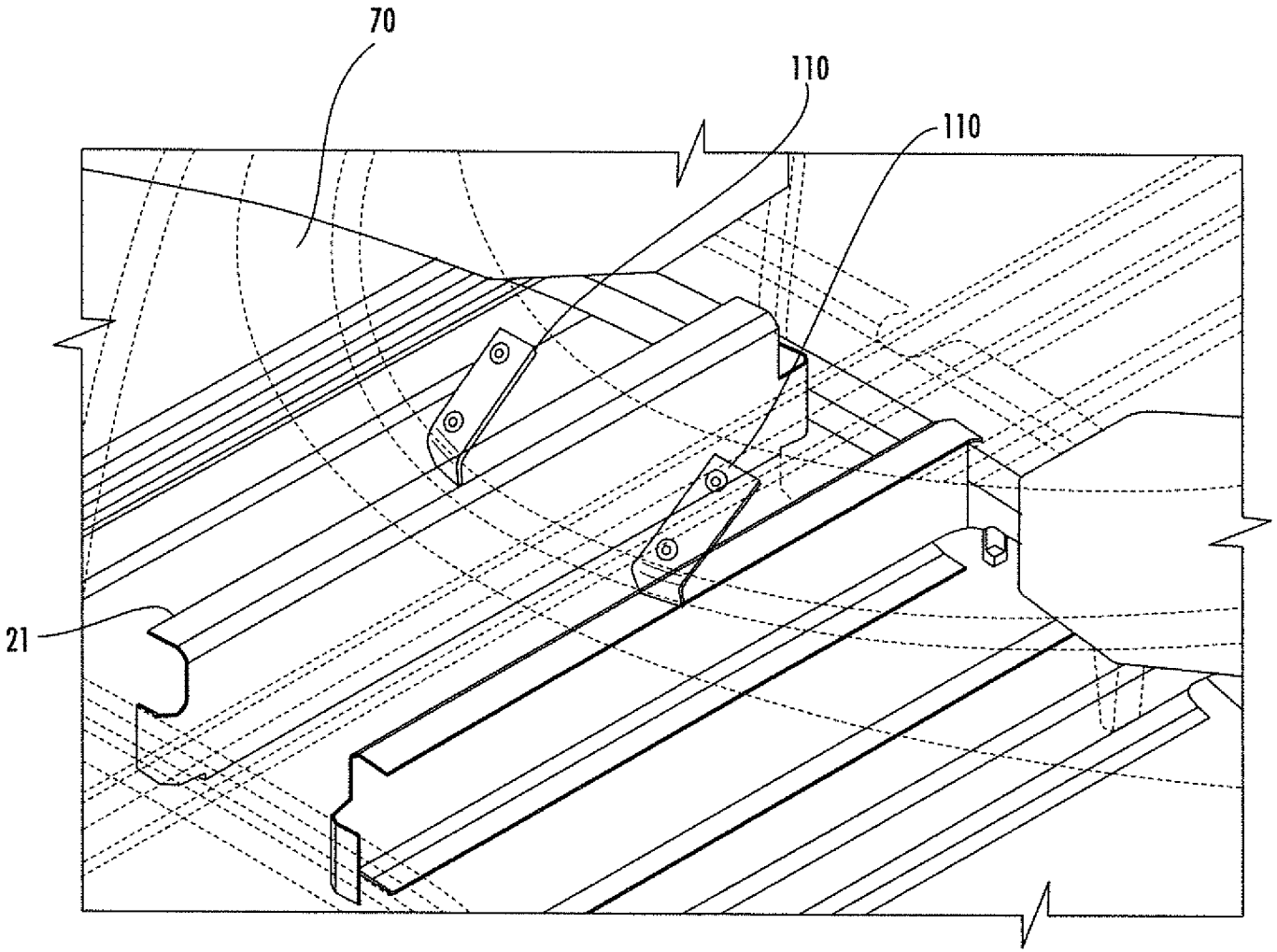
FIG. 8 is a more detailed perspective view of the fore attachment fittings illustrated in FIG. 7.

The fore attachment fittings 110 are triangular-shaped and are hard mounted between the fuselage 21 and the fairing 70, as illustrated in FIG. 8. Since the fore attachment fittings 110 do not float, they react to vertical pull off forces, longitudinal drag forces and lateral gust forces. Another advantage of the fore attachment fittings 110 is that they also reduce deflection or deformation in the event of a bird strike.

Figure 9:
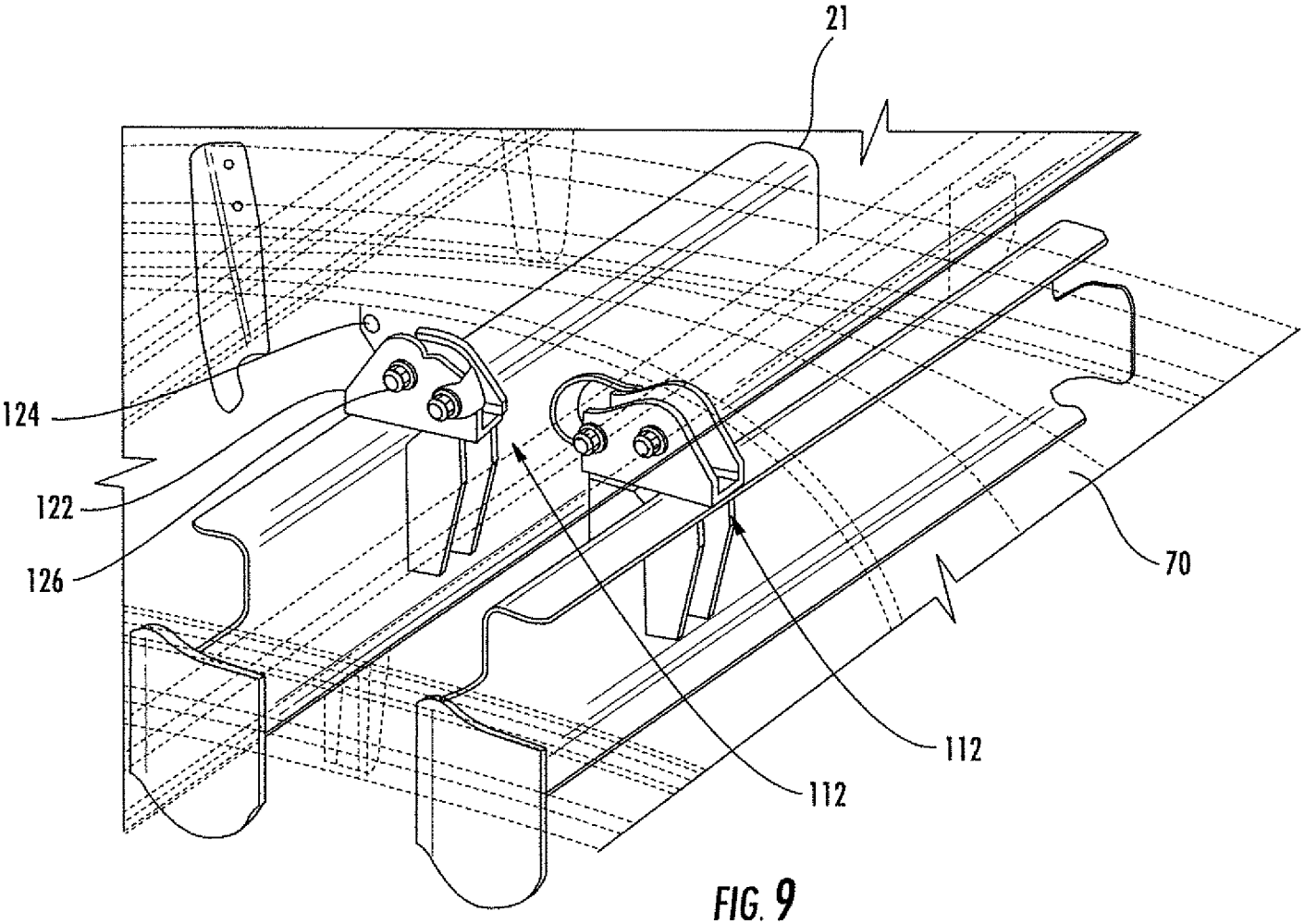
FIG. 9 is a more detailed perspective view of the aft attachment fittings illustrated in FIG. 7.

The aft attachment fittings 112 include a fuselage mounting bracket 122 coupled to the fuselage 21 via clevis bolts, and a fairing mounting bracket 124 coupled to the fairing 70 via bolts, as illustrated in FIG. 9. A connecting bolt 126 couples together the fuselage mounting bracket 122 and the fairing mounting bracket 124.

The aft attachment fittings 112 react to vertical and lateral loads and permit longitudinal displacement. The connecting bolt 126 allows the antenna assembly 30 to float in the longitudinal direction, which may be as a result of pressurization, thermal expansion or any forces that change longitudinally on the aircraft 20 so as to not work these forces back into the fuselage 21.

Figure 10:
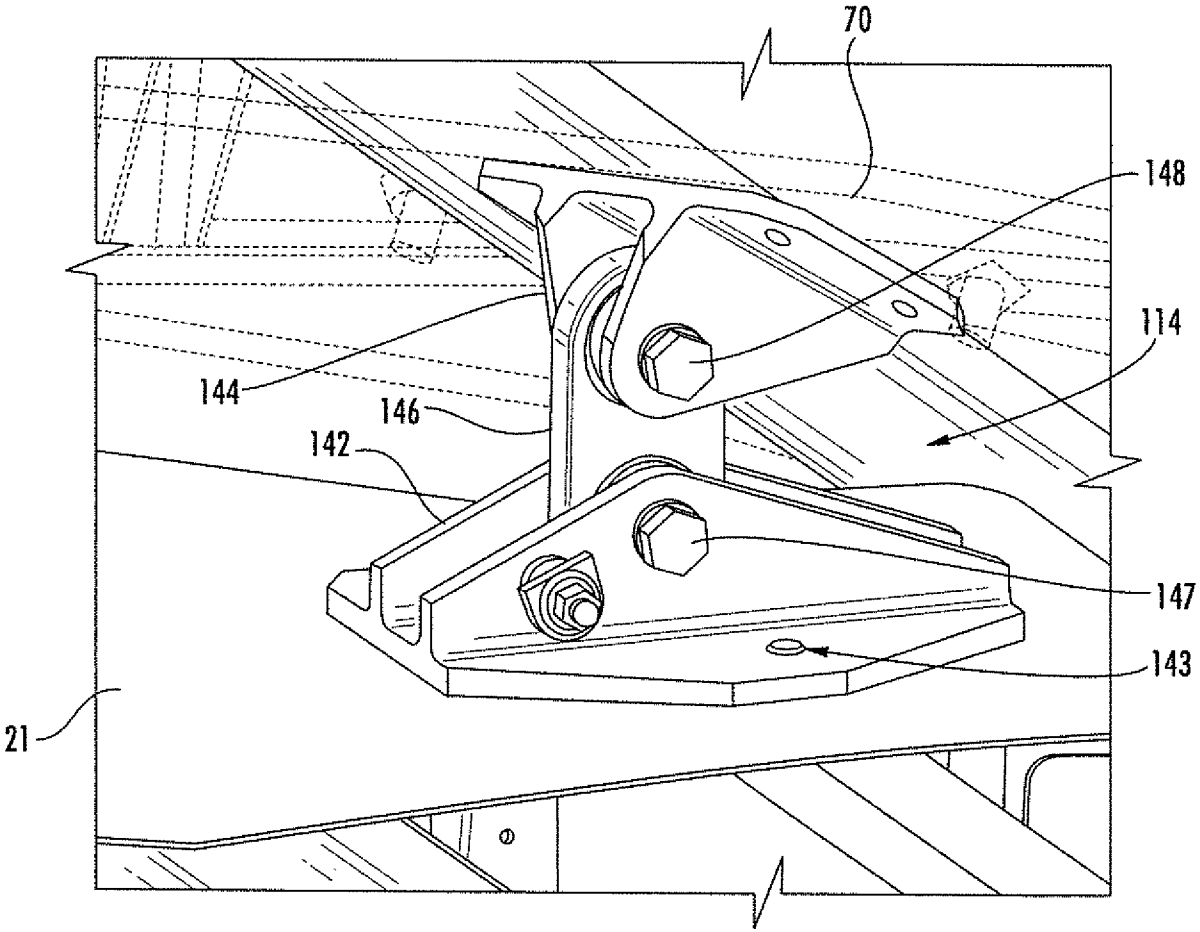
FIG. 10 is a more detailed perspective view of one of the side attachment fittings illustrated in FIG. 7.
Figure 11:
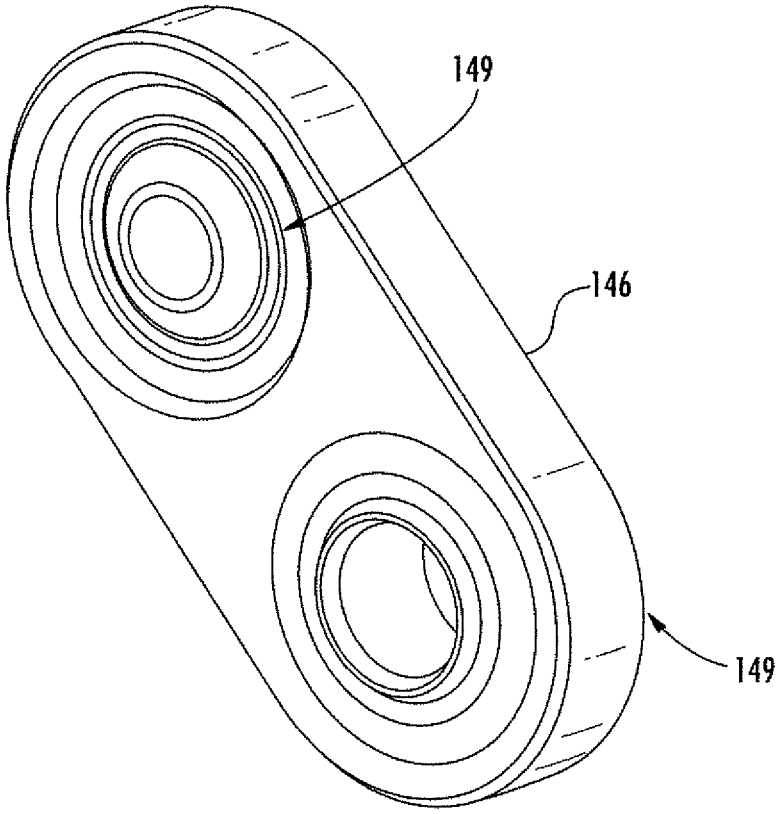
FIG. 11 is a perspective view of a coupling link used in the side attachment fitting illustrated in FIG. 10.

The left side attachment fittings 114 and the right side attachment fittings 116 each comprises a fuselage mounting bracket 142 coupled to the fuselage 21 via hi-lok bolts 143 and a fairing mounting bracket 144 coupled to the fairing 70, as illustrated in FIG. 10. A coupling link 146 is between the fuselage mounting bracket 142 and the fairing mount bracket 144. The coupling link 146 includes roller bearings 149, as illustrated in FIG. 11.

The left and right side attachment fittings 114, 116 react to vertical loads and permit lateral and longitudinal displacement. The coupling links 146 advantageously rotate left and right to permit lateral displacement, and slightly rotate based on the roller bearings 149 at either end to permit longitudinal displacement. The coupling links 146 also float on the axis of each of the bolts 147, 148 to permit longitudinal displacement.

Figure 2:
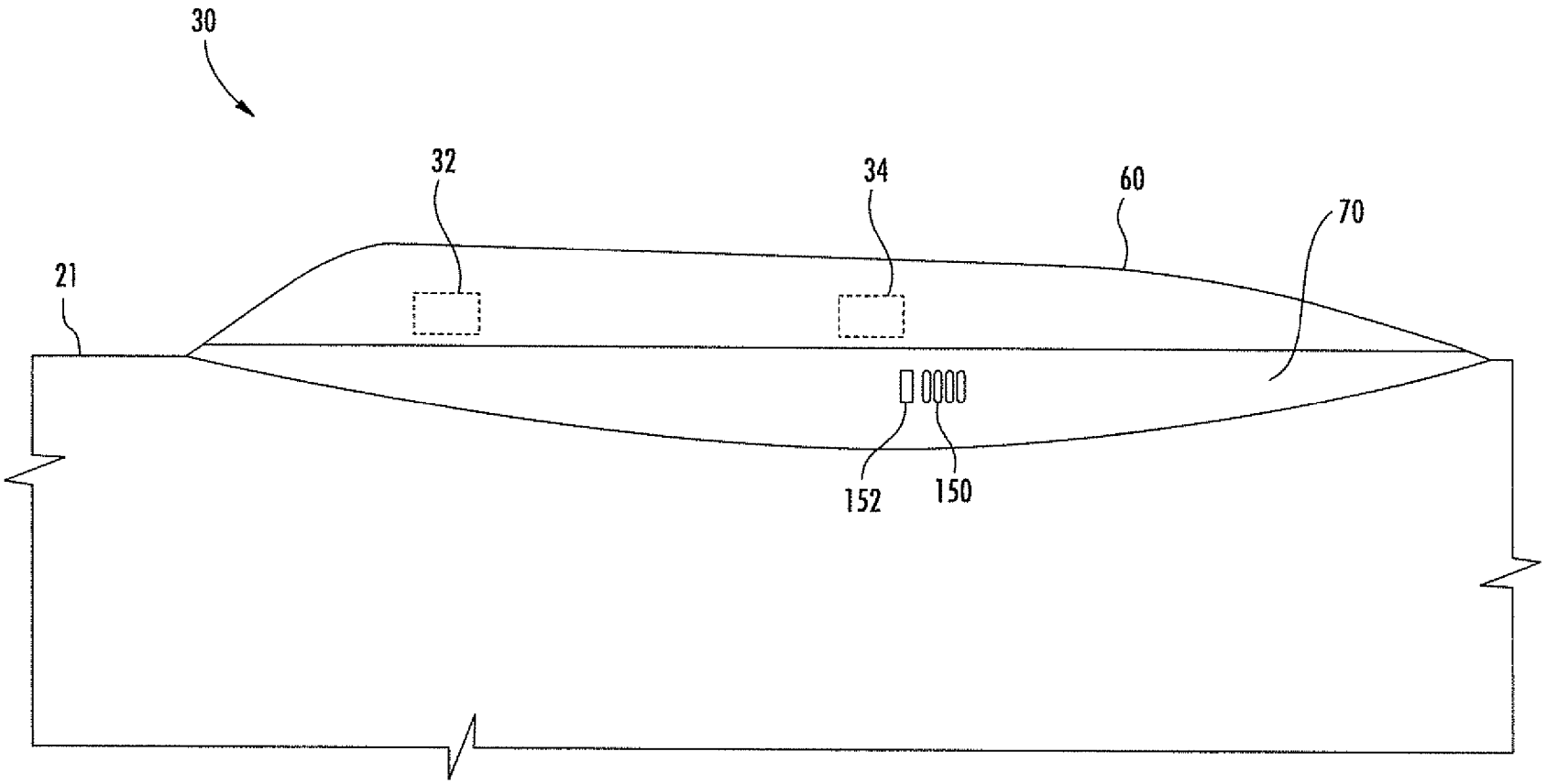
FIG. 2 is a side view of the antenna assembly illustrated in FIG. 1.
Figure 3:
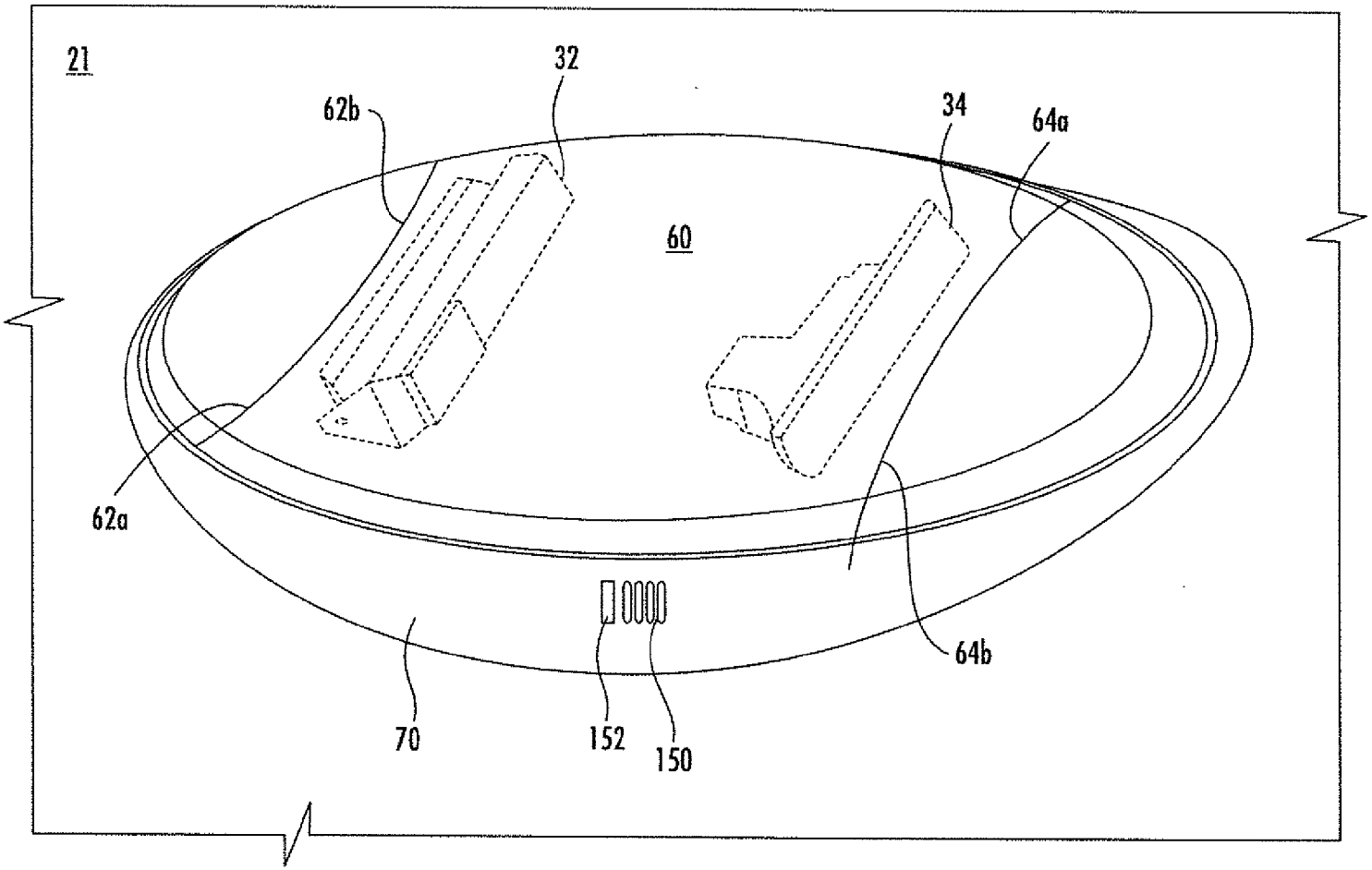
FIG. 3 is a more detailed perspective view of the antenna assembly illustrated in FIG. 1.
Figure 4:
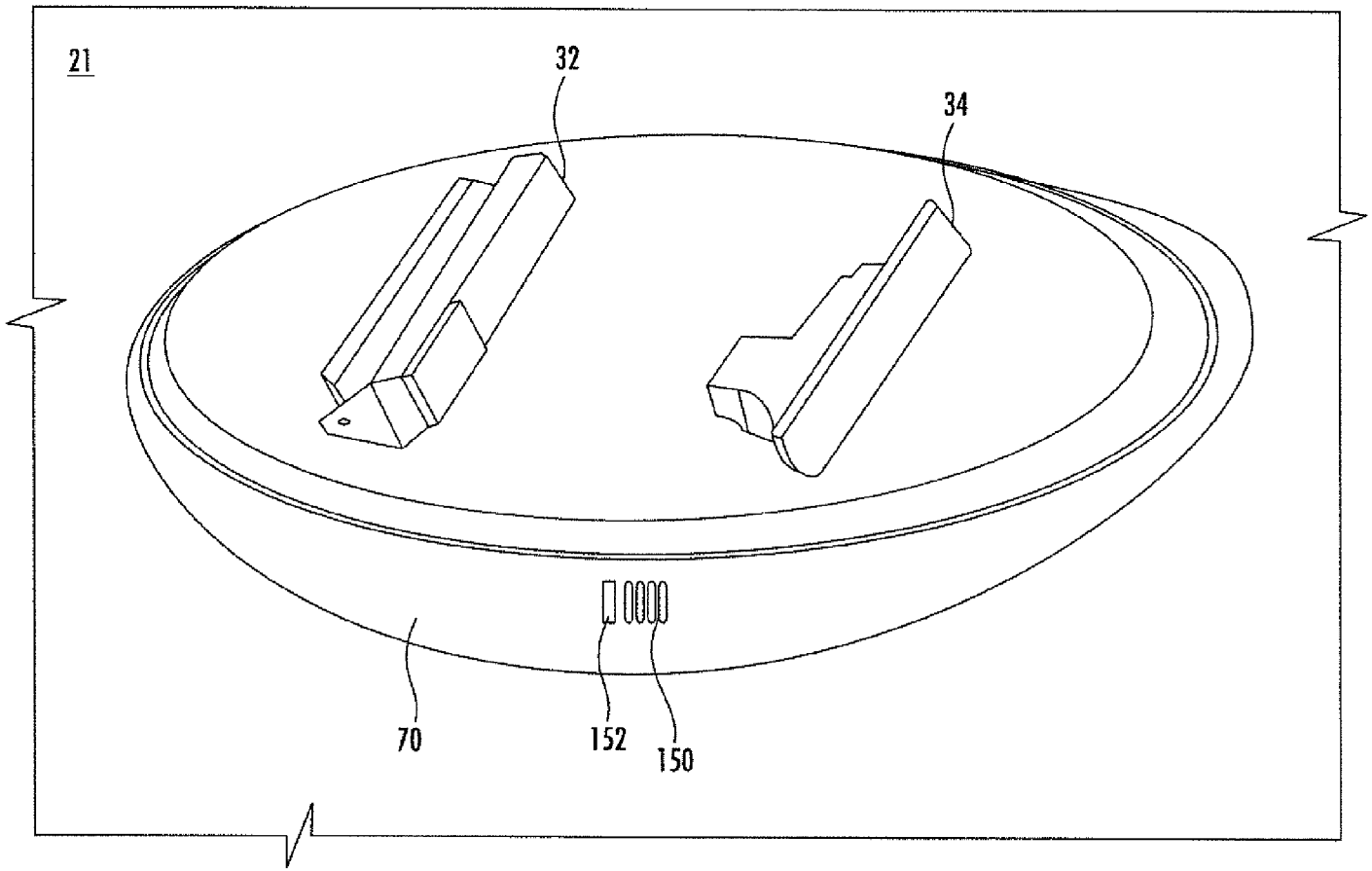
FIG. 4 is a more detailed perspective view of the antenna assembly illustrated in FIG. 1 without the radome.
Figure 12:
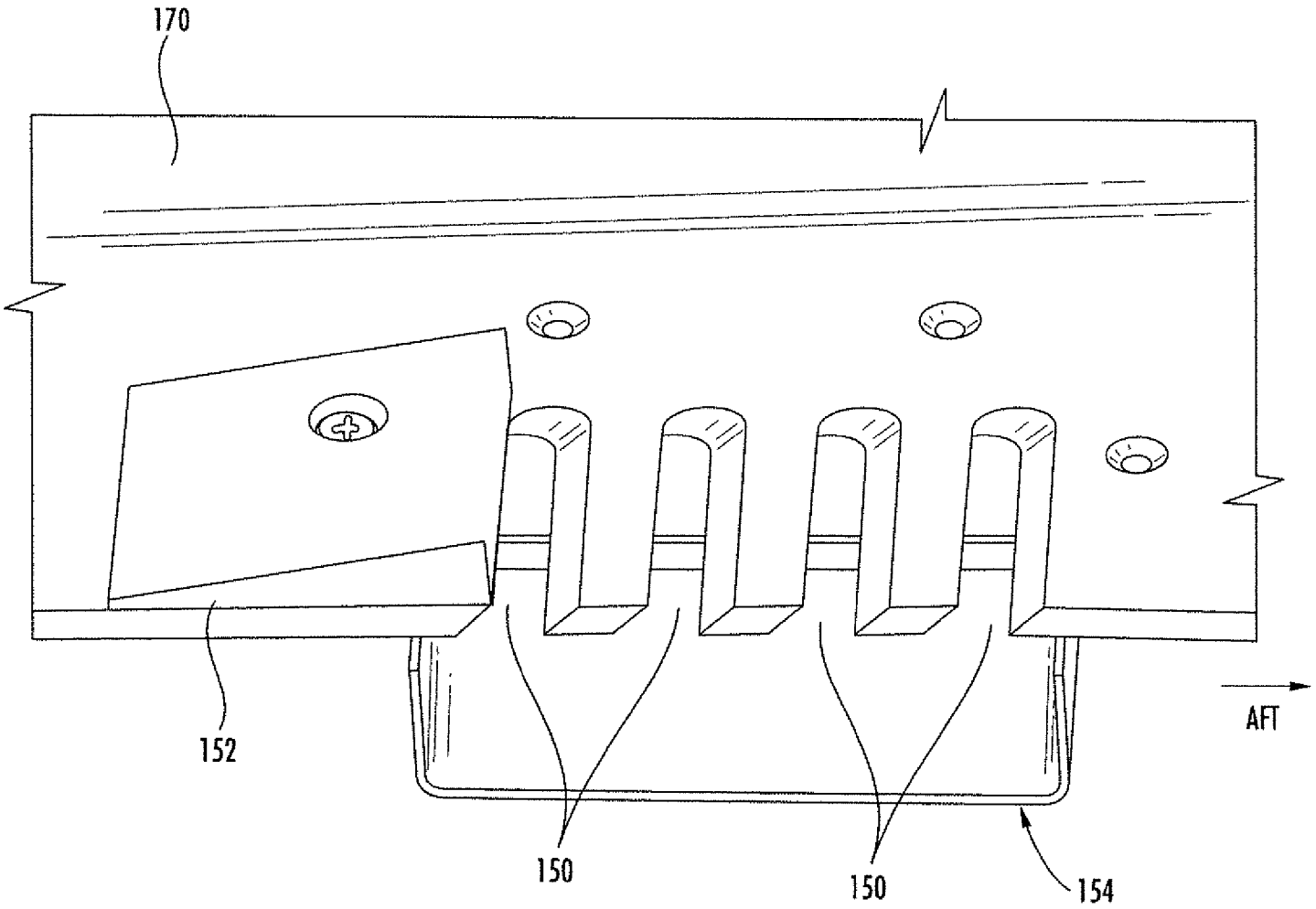
FIG. 12 is a more detailed perspective partial view of the vent openings in the fairing as illustrated in FIG. 2.

The fairing 70 includes a plurality of vent openings 150, as illustrated in FIGS. 2-4, that allow the pressure within the antenna assembly 30 to normalize to ambient pressure. A close-up partial view of the vent openings 150 is illustrated in FIG. 12. Vent openings are also on the opposite side of the fairing 70.

The plurality of vent openings 150 are preferably located where there is a null in the aerodynamic pressure curve. The fairing 70 has an oval shape defining left and right side low pressure regions when the aircraft 20 is in flight. A first set of openings 150 is associated with the left side low pressure region, and a second set of openings is associated with the right side low pressure region.

The first and second sets of vent openings 150 create a venturi effect that helps to offset the aerodynamic lift loads. The aerodynamic lift loads may be 4,000 pounds, for example. With the aircraft 20 traveling at 300 knots, for example, the aerodynamic lift loads may be offset 2,000 to 3,000 pounds because of the venturi effect created by the first and second set of vent openings 150.

An airflow deflector 152 is carried by the fairing 70 and cooperates with the vent openings 150 to lower pressure within the radome 60 during flight of the aircraft 20. One airflow deflector 152 is associated with the first set of vent openings 150 and another airflow deflector is associated with the second set of vent openings. The airflow deflector 152 is wedged shape and is bolted to the fairing 70.

A cover 154 is placed adjacent the vent openings 150 on an inside of the fairing 70 to direct fluids that may pass through the vent openings away from the first and second satellite antennas 32, 34. One cover 154 is associated with the first set of vent openings 150 and another cover is associated with the second set of vent openings. Each of the covers 154 direct fluid in a downward direction for drainage at a seal low point.

Figure 13:
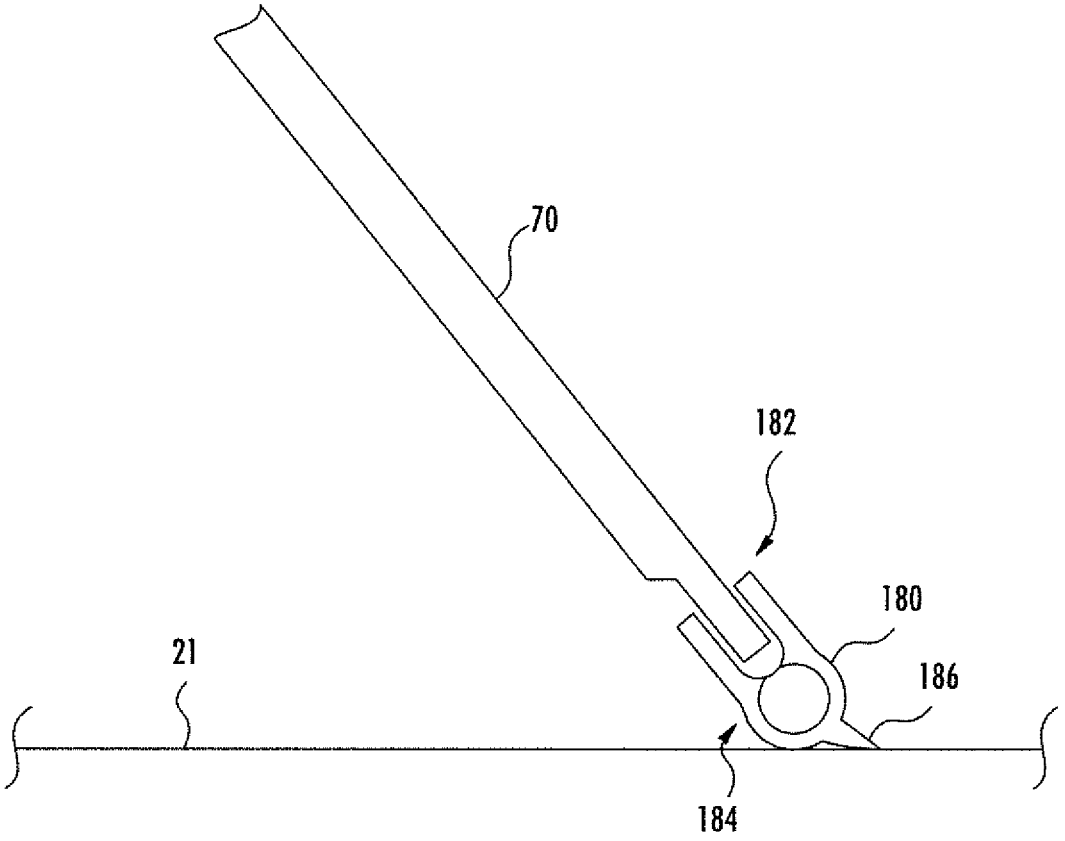
FIG. 13 is a cross-sectional side view of the fairing and seal in accordance with the present invention.

The antenna assembly further includes an elastomeric seal 180 mounted on a lower edge of the fairing 70 adjacent the fuselage 21, as illustrated in FIG. 13. The seal 180 is a trim-lok seal. The seal 180 has a wiper design and compresses at installation, and airflow further compresses against the fuselage 21. The seal 180 advantageously allows for bursting or burping pressure relief under rapid decompression. There is also a radome seal between the radome 60 and the fairing 70. The radome seal has a zero-cure time or a near zero-cure time which advantageously allows the radome to be removed and re-attached in a short period of time, such as during a maintenance interval. Although not illustrated, the radome 60 may also includes a number of features to assist in lifting and handling of the radome.

One end 182 of the seal 180 has an open u-shaped configuration for receiving the lower edge of the fairing 70. The other end 184 of the seal 180 has a closed circular-shaped configuration for contacting the skin of the fuselage 21. The interior of the closed circular-shaped configuration may be hollow. Extending outwards and away from the center of the radome 60 is a lip 186 that also contacts the skin of the fuselage 21.

Figure 14:
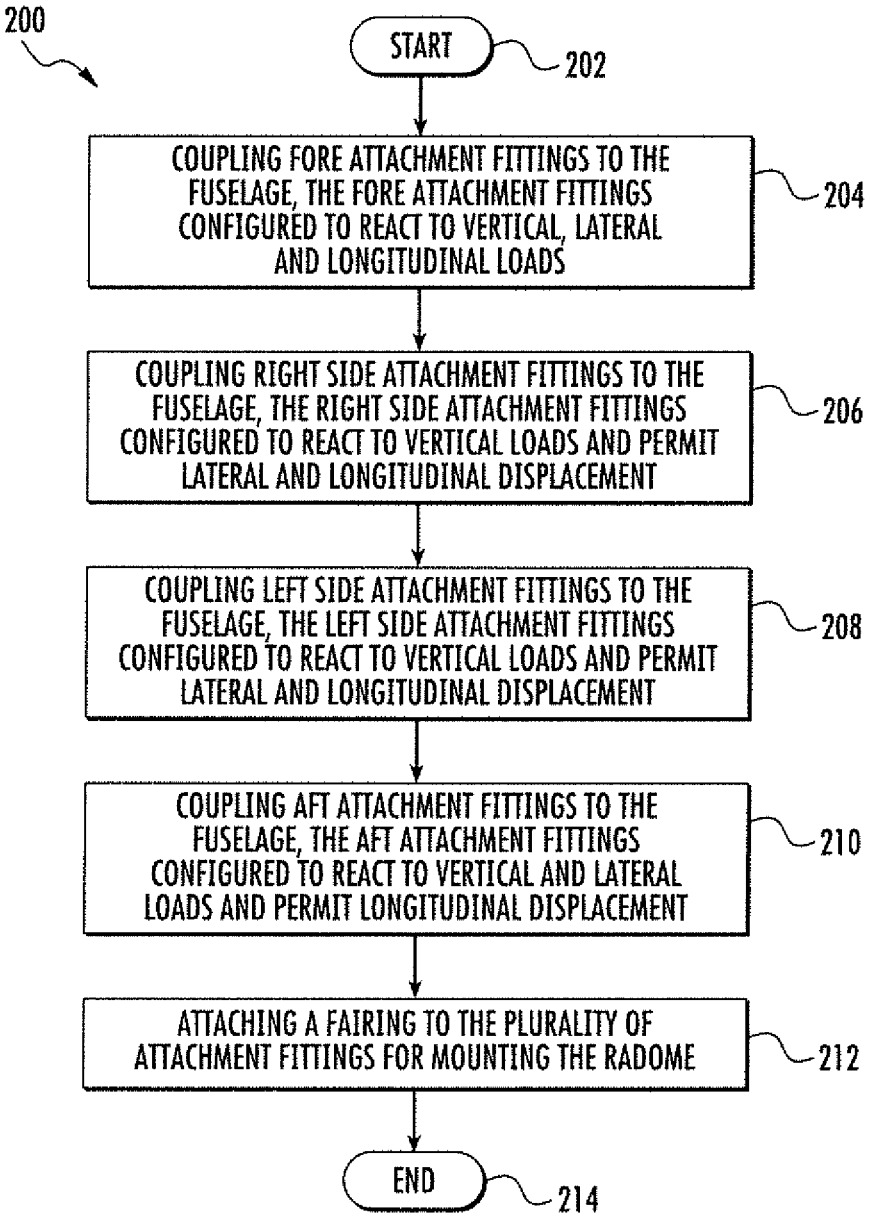
FIG. 14 is a flowchart of a method for mounting a radome to cover at least one satellite antenna mounted on a fuselage of an aircraft in accordance with the present invention.

A method for mounting a radome 60 to cover at least one satellite antenna 32 mounted on the fuselage 21 of an aircraft 20 will now be discussed in reference to the flowchart 200 provided in FIG. 14. From the start (Block 202), the method comprises coupling fore attachment fittings 110 to the fuselage 21 at Block 204. The fore attachment fittings 110 are configured to react to vertical, lateral and longitudinal loads. The right side attachment fittings 116 are coupled to the fuselage 21 at Block 206. The right side attachment fittings 116 are configured to react to vertical loads and permit lateral and longitudinal displacement. The left side attachment fittings 114 are coupled to the fuselage 21 at Block 208. The left side attachment fittings 114 are configured to react to vertical loads and permit lateral and longitudinal displacement. The aft attachment fittings 112 are coupled to the fuselage 21 at Block 210. The aft attachment fittings 112 are configured to react to vertical and lateral loads and permit longitudinal displacement. The method further comprises attaching the fairing 70 at Block 212 to the attachment fittings 110, 112, 114, 116 for mounting the radome 70. The method ends at Block 214.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna assembly for a fuselage of an aircraft comprising:

at least one satellite antenna;

a radome covering said at least one satellite antenna;

a plurality of attachment fittings for coupling to the fuselage of the aircraft and comprising at least one fore attachment fitting configured to react to vertical, lateral and longitudinal loads, at least one right side attachment fitting configured to react to vertical loads and permit lateral and longitudinal displacement, at least one left side attachment fitting configured to react to vertical loads and permit lateral and longitudinal displacement, and at least one aft attachment fitting configured to react to vertical and lateral loads and permit longitudinal displacement; and a fairing for mounting said radome to said plurality of attachment fittings.

2. The antenna assembly according to claim 1 wherein said fairing has at least one vent opening therein.

3. The antenna assembly according to claim 2 further comprising at least one airflow deflector carried by said fairing and cooperating with the at least one vent opening to lower a pressure within said radome during flight of the aircraft.

4. The antenna assembly according to claim 2 wherein said fairing has an oval shape defining right and left side low pressure regions when the aircraft is in flight; and wherein said at least one vent opening includes:

a first set of openings associated with the right side low pressure region; and a second set of openings associated with the left side low pressure region left side of said fairing.

5. The antenna assembly according to claim 1 wherein said at least one fore attachment fitting comprises a pair of laterally spaced apart fore attachment fittings.

6. The antenna assembly according to claim 1 wherein each of said right and left side attachment fittings comprises:

a fuselage mounting bracket to be coupled to the fuselage of the aircraft;

a fairing mounting bracket coupled to the fairing; and a coupling link between said fuselage mounting bracket and said fairing mounting bracket.

7. The antenna assembly according to claim 6 wherein said coupling link is rotatably coupled to at least one of said fuselage mounting bracket and said fairing mounting bracket.

8. The antenna assembly according to claim 1 wherein said at least one satellite antenna is operable in at least one frequency range between 12 to 40 GHz.

9. The antenna assembly according to claim 1 wherein said at least one satellite antenna comprises:

a first satellite antenna operable in a first frequency range; and a second satellite antenna operable in a second frequency range.

10. The antenna assembly according to claim 1 wherein said radome comprises a dielectric material, and at least one lightning protection element carried by said dielectric material.

11. The antenna assembly according to claim 1 further comprising an elastomeric seal mounted on a lower edge of said fairing adjacent the fuselage of the aircraft.

12. A fairing assembly for mounting a radome to cover at least one satellite antenna mounted on a fuselage of an aircraft, the fairing assembly comprising:

a plurality of attachment fittings for coupling to the fuselage of the aircraft and comprising at least one fore attachment fitting configured to react to vertical, lateral and longitudinal loads, at least one right side attachment fitting configured to react to vertical loads and permit lateral and longitudinal displacement, at least one right side attachment fitting configured to react to vertical loads and permit lateral and longitudinal displacement, at least one left side attachment fitting configured to react to vertical loads and permit lateral and longitudinal displacement, and at least one aft attachment fitting configured to react to vertical and lateral loads and permit longitudinal displacement; and a fairing for mounting the radome to said plurality of attachment fittings.

13. The fairing assembly according to claim 12 wherein said fairing has at least one vent opening therein.

14. The fairing assembly according to claim 13 further comprising at least one airflow deflector carried by said fairing and cooperating with the at least one vent opening to lower a pressure within said radome during flight of the aircraft.

15. The fairing assembly according to claim 13 wherein said fairing has an oval shape defining right and left side low pressure regions when the aircraft is in flight; and wherein said at least one vent opening includes:

a first set of openings associated with the right side low pressure region; and a second set of openings associated with the left side low pressure region left side of said fairing.

16. The fairing assembly according to claim 12 wherein said at least one fore attachment fitting comprises a pair of laterally spaced apart fore attachment fittings.

17. The fairing assembly according to claim 12 wherein each of said right and left side attachment fittings comprises:

a fuselage mounting bracket to be coupled to the fuselage of the aircraft;

a fairing mounting bracket coupled to the fairing; and a coupling link between said fuselage mounting bracket and said fairing mounting bracket.

18. The fairing assembly according to claim 17 wherein said coupling link is rotatably coupled to at least one of said fuselage mounting bracket and said fairing mounting bracket.

19. The fairing assembly according to claim 12 further comprising an elastomeric seal mounted on a lower edge of said fairing adjacent the fuselage of the aircraft.

20. A method for mounting a radome to cover at least one satellite antenna mounted on a fuselage of an aircraft, the method comprising:

coupling a plurality of attachment fittings to the fuselage of the aircraft and comprising at least one fore attachment fitting configured to react to vertical, lateral and longitudinal loads, at least one right side attachment fitting configured to react to vertical loads and permit lateral and longitudinal displacement, at least one left side attachment fitting configured to react to vertical loads and permit lateral and longitudinal displacement, and at least one aft attachment fitting configured to react to vertical and lateral loads and permit longitudinal displacement; and attaching a fairing to the plurality of attachment fittings for mounting the radome.

21. The method according to claim 20 wherein the fairing has at least one vent opening therein.

22. The method according to claim 21 further comprising at least one airflow deflector coupled to the fairing and cooperating with the at least one vent opening to lower a pressure within the radome during flight of the aircraft.

23. The method according to claim 20 wherein the at least one fore attachment fitting comprises a pair of laterally spaced apart fore attachment fittings.

24. The method according to claim 20 wherein each of the right and left side attachment fittings comprises:

a fuselage mounting bracket coupled to the fuselage of the aircraft;

a fairing mounting bracket coupled to the fairing; and a coupling link between the fuselage mounting bracket and the fairing mounting bracket.

25. The method according to claim 24 wherein the coupling link is rotatably coupled to at least one of the fuselage mounting bracket and the fairing mounting bracket.

* * * * *